US006655560B2

(12) United States Patent
Kahn

(10) Patent No.: US 6,655,560 B2
(45) Date of Patent: Dec. 2, 2003

(54) CORDLESS TOOL HOLDER ADAPTOR

(76) Inventor: Peter P. Kahn, 381 S. Country Rd., Brookhaven Hamlet, NY (US) 11719

( * ) Notice: Subject to any disclaimer, the term of this patent is extended or adjusted under 35 U.S.C. 154(b) by 177 days.

(21) Appl. No.: 09/985,524

(22) Filed: Nov. 5, 2001

(65) Prior Publication Data

US 2003/0085243 A1 May 8, 2003

(51) Int. Cl.[7] ..... A45F 5/00

(52) U.S. Cl. ..... 224/268; 224/197; 224/250; 224/904

(58) Field of Search ..... 224/197, 247, 224/250, 268, 677; 294/149, 150, 167; 248/294.1, 304, 305

(56) References Cited

U.S. PATENT DOCUMENTS 845,348 A * 2/1907 Gibson ..... 224/197
4,357,044 A * 11/1982 Woodworth ..... 248/294.1
4,917,281 A * 4/1990 Ostermiller ..... 224/904
5,255,947 A * 10/1993 Schwartz ..... 294/150
5,915,610 A * 6/1999 Russell ..... 224/197
5,971,238 A * 10/1999 Malvasi et al. ..... 224/250
6,062,449 A * 5/2000 Kahn ..... 224/268
6,199,736 B1 * 3/2001 Musarella et al. ..... 224/904
6,315,179 B1 * 11/2001 Hillis ..... 224/268
6,325,577 B1 * 12/2001 Anderson ..... 224/904
6,557,739 B1 * 5/2003 Pursley et al. ..... 224/677

* cited by examiner

*Primary Examiner*—Gary E. Elkins
(74) *Attorney, Agent, or Firm*—Peter A. Borsari

(57) ABSTRACT

A tool accessory is provided in the form of a cordless tool holder adaptor which is capable of being secured to a cordless tool, particularly a cordless power tool having a handle member with a lower flanged end, in order to provide the tool with means to enable it to be suspended from a holding device. In particular, the cordless tool holder adaptor is secured to the lower end of the handle of a tool, such as a cordless power drill such that the tool can be suspended from a belt clip having a swivelable hook member.

19 Claims, 3 Drawing Sheets

CORDLESS TOOL HOLDER ADAPTOR

FIELD OF INVENTION

The present invention relates to tool accessories which facilitate the carrying tools. More specifically, the present invention relates to a tool accessory which is capable of being secured to a cordless tool, particularly a cordless power tool having a handle member with a lower flanged end, in order to provide the tool with means to enable it to be suspended from a holding device. In particular, the present invention relates to a tool holder adaptor which is secured to the handle of a tool, such as a cordless power drill such that the tool can be suspended from a belt clip hook member.

BACKGROUND OF THE INVENTION

The prior art is replete with tool accessories designed to retain one or more tools. Most common among such tool accessories are tool belts, provided with cloth, leather or steel loops which depend from the belt and which function to retain a variety of tools. Tool belts have inherent limitations, a primary limitation being that the structure and non-adjustability of the loops can make it difficult to extract or insert tools of varying size.

More recently, tool belt clips have been developed which are removably attachable to a tool belt or regular belt. Some of these tool belt clips are designed solely to carry a particular tool. Other tool belt clips are provided with a hook member from which a tool can be suspended. An example of such a tool belt clip is the "Tool Belt Tote Device", which comprises a belt clip, a swivel element and a swivelable hook member, as described in U.S. Pat. No. 6,062,449 issued May 16, 2000 to Peter P. Kahn, the inventor of the present invention. The entire disclosure of U.S. Pat. No. 6,062,449 is hereby incorporated by reference.

A drawback to the typical tool belt clip having a hook member is that not all tools can be suspended from the hook member. Tools having an attached loop or a similar enclosed opening can be suspended simply from a hook member by introducing the hook or enclosed opening over the end of the hook member. Suspension from a U-shaped hook member of certain other tools also can be achieved when the tool is constructed with a "notch", indentation, depression or similar cavity of sufficient depth such that the "notch" can be guided within the "U" and is retained therein by the opposing sides of the "notch". Tools that have neither feature are difficult, if not impossible, to suspend from hook member.

Despite the teachings of the prior art, a need still exists for a device which can be secured to a tool, particular a cordless power tool, that enables the power tool to be suspended from a hook member of a tool belt clip. Such a device should be capable of being quickly and easily secured to the cordless tool. Such a device also should enable the cordless tool to be quickly and safely suspended from a hook member of a tool belt clip. In addition, such as device should be simple and inexpensive to manufacture, but be of durable construction.

SUMMARY OF THE INVENTION

Accordingly, it is an object of the present invention to provide a cordless tool holder adaptor which is securable to a cordless tool in such a manner that the cordless tool can be suspended from a tool belt clip hook member.

It is another object of the present invention to provide a cordless tool holder adaptor which can be secured quickly and easily to a cordless tool.

It is an additional object of the present invention to provide a cordless tool holder adaptor which will enable a cordless tool to be quickly and safely suspended from a hook member of a tool belt clip.

It is a further object of the present invention to provide a cordless tool holder adaptor which is simple and inexpensive to manufacture and is of durable construction.

Additional objects, advantages and novel features of the invention will be set forth in part of the description which follows, and in part will become apparent to those skilled in the art upon examination of the following specification or may be learned by practice of the invention.

These and other objects of the present invention are accomplished by providing a cordless tool holder adaptor comprising a conventional cable tie having a first locking head end and a second tail end and two ball elements, each of the ball elements having a centrally disposed aperture of a diameter sufficient to receive either end of the cable tie. The tail end of the cable tie is introduced through the locking head to form a collar which is placed over the base of the handle of a cordless tool. The two ball elements are aligned to the center on either side of the handle and the tail end is pulled tightly about the handle. In this manner, the handle of the cordless tool is provided a supplemental flange. The handle of the cordless tool is placed within a U-shaped hook member such that the two ball elements are situated on the side of the hook member opposite that of the lower end of the handle, thereby suspending the cordless tool from the hook member.

BRIEF DESCRIPTION OF THE DRAWINGS

The present invention will be better understood with reference to the appended drawing sheets, wherein.

DETAILED DESCRIPTION

The present invention relates to a tool accessory which is capable of being secured to a cordless tool, particularly a cordless power tool having a handle member with a lower flanged end, in order to provide the tool with means to enable it to be suspended from a holding device. In particular, the present invention relates to a cordless tool holder adaptor which is secured to the handle of a tool, such as a cordless power drill such that the tool can be suspended from a belt clip hook member.

Figure 1:
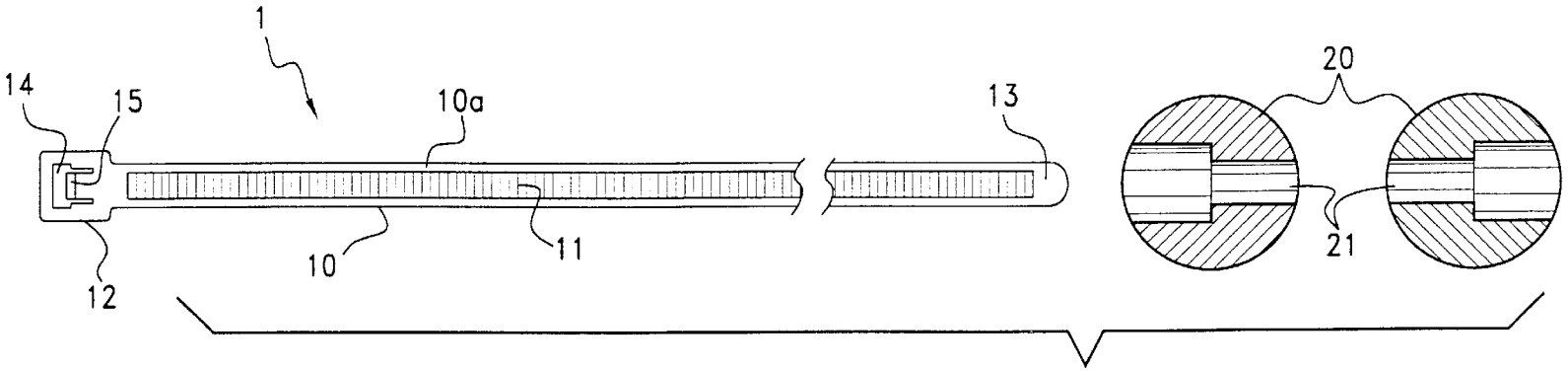
FIG. 1 is a top perspective view of the cordless tool holder adaptor of the present invention.

As shown in FIG. 1, the cordless tool holder adaptor 1 of the present invention comprises a conventional cable tie 10 in the form of an elongated strap having a first surface 10*a* provided with a plurality of teeth 11, a locking head end 12 and a tail end 13, the locking head end 12 having a locking aperture 14 disposed therein which is capable of receiving the tail end 13. The locking aperture 14 is provided with a locking mechanism 15 which engages the plurality of teeth 11, in order to retain the elongated strap therein. Preferably, the locking mechanism 15 is designed to enable the elongated strap to be released therefrom. The cordless tool holder adaptor 1 further comprises two spacer elements 20, each spacer element being provided with a central aperture 21 therethrough, the central aperture having a diameter of sufficient size such that the cable tie 10 can be introduced through each of the spacer elements 20. Although the spacer elements can be of any design as will be obvious to one skilled in the art, preferably, the spacer elements are in the form of spheres or balls. The spacer element can be constructed of any material having sufficient strength and durability, suitable materials including, for example, plastics, metals, fiberglass and wood materials. In a preferred embodiment, the spacer elements are composed of hard plastic.

Figure 2:
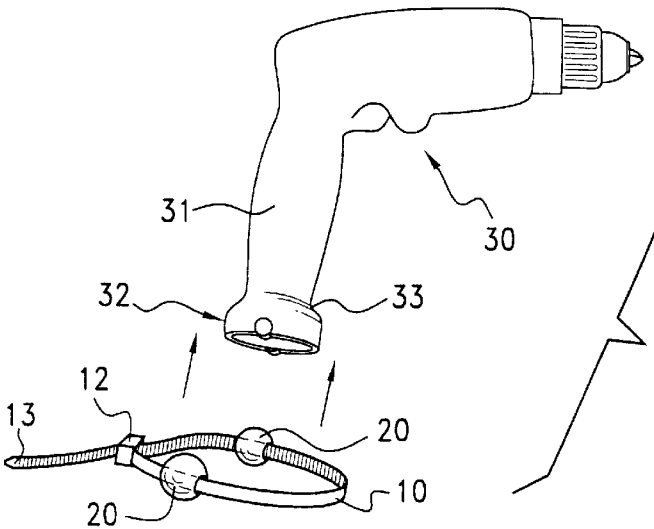
FIG. 2 is a side perspective view of the cordless tool holder adaptor of the present invention secured to a cordless power drill.
Figure 3:
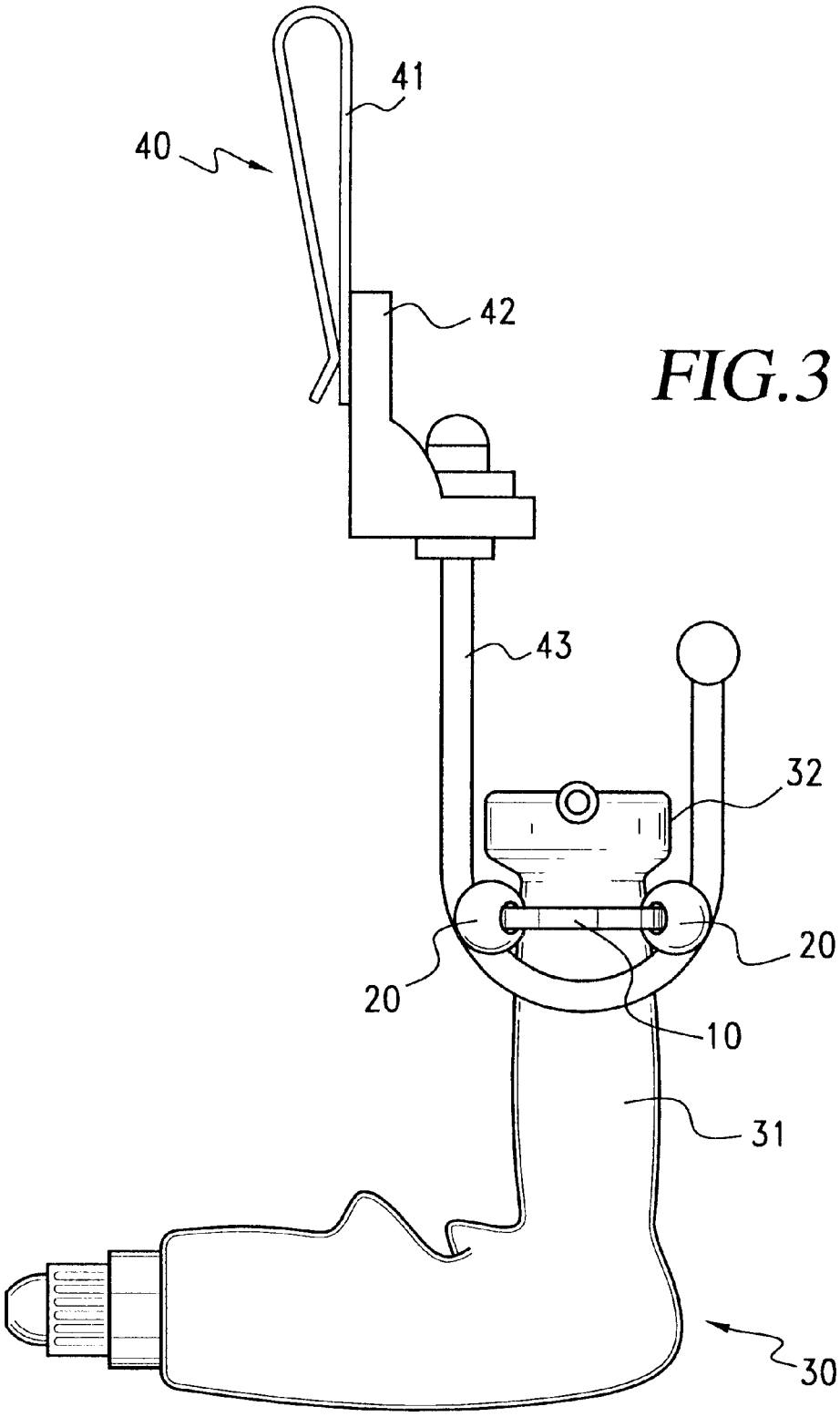
FIG. 3 is a side perspective view of the cordless tool holder adaptor of the present invention secured to a cordless power drill and suspended from a tool belt clip hook member.
Figure 4:
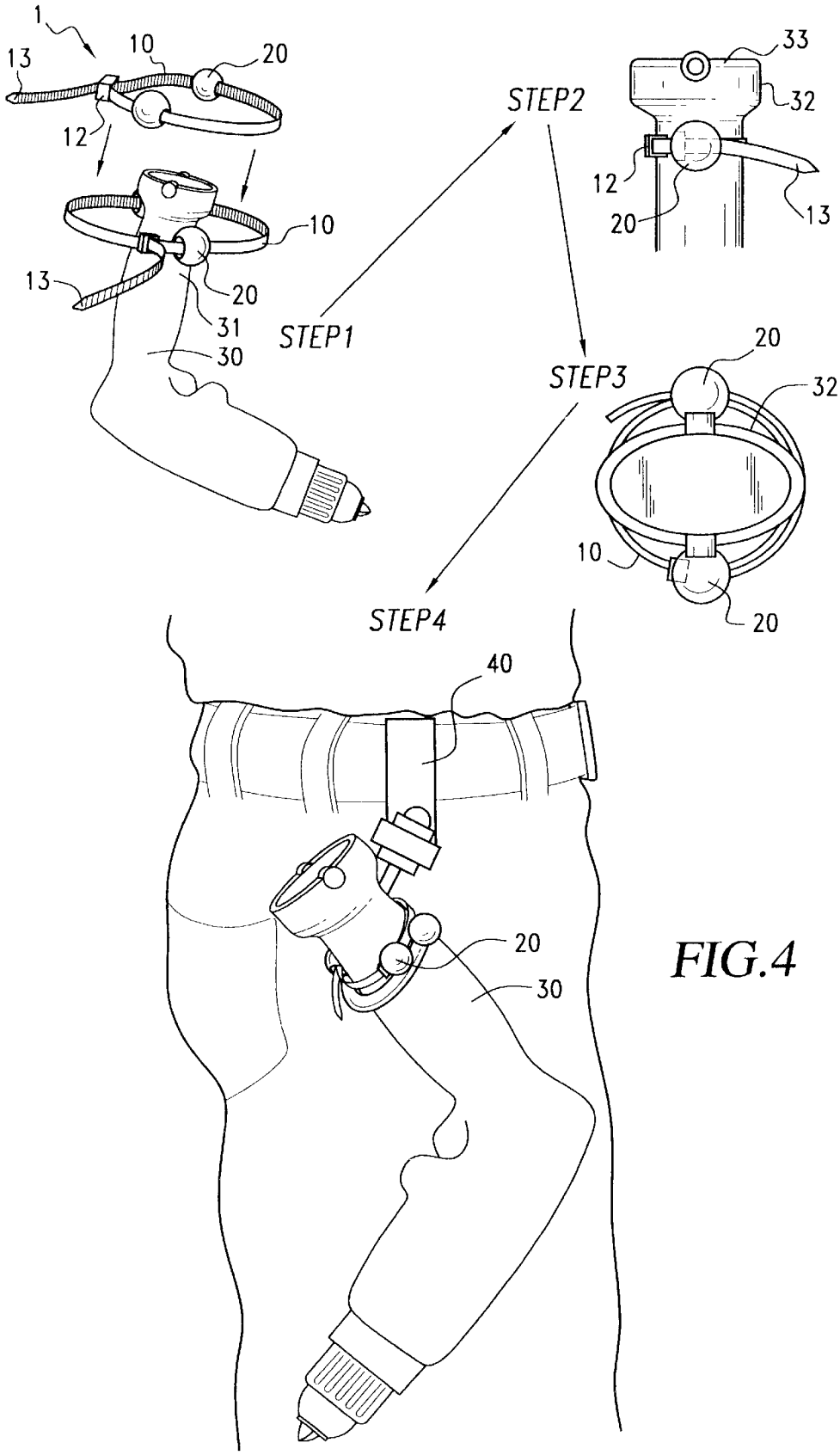
FIG. 4 is an step-by-step illustration showing the installation of the cordless tool holder adaptor onto a cordless power drill and the suspension of the combination adaptor and power drill onto a tool belt clip hook member.

Referring to FIGS. 2, 3 and 4, the cordless tool holder adaptor 1 is installed and secured to a cordless tool 30 having a handle member 31 with a lower end 32. Preferably, the lower end 32 of handle member 31 is provided with a flange 33. The tail end 13 of the cable tie 10 is introduced through each of the two spacer elements 20 and through the locking aperture 14 of locking head end 12, thereby forming a collar which is placed over the lower end 32 of the handle member 31 of the cordless tool 30. The two spacer elements are centrally aligned on either side of the handle member 31 and the tail end 13 is pulled tightly about the handle until the cordless tool holder adaptor 1 is securely fastened to the handle member 31 and cannot be rotated about the handle member.

The installation of the cordless tool holder adaptor 1 onto the cordless tool 30 creates a combination assembly that can be suspended from a hook member 43 of a tool belt clip 40, having a belt clip element 41 as particularly shown in FIG. 3. More specifically, the handle member 31 of the cordless tool 30 is placed within the hook member 43 such that the lower end 32 of the handle member is situated on one side of the hook member 43 and the two spacer elements 20 are situated on the opposite side of the hook member 43. When the tool belt clip 40 comprises a swivel element 42 such that both the swivel element and hook element can swivel freely and independently of one another, the cordless tool 30 suspended from the hook member 43 will swivel in order to maintain its center of gravity.

FIG. 4 shows the quick and easy installation of the cordless tool holder adaptor 1 onto a cordless tool 30 and the suspension of the combination assembly from a tool belt clip 40. In Step 1, the tail end 13 of the cable tie 10 is introduced through each of the two spacer elements 20 and through the locking aperture 14 of locking head end 12, thereby forming a collar which is placed over the lower end 32 of the handle member 31 of the cordless tool 30. In Step 2, the tail end 13 is pulled tightly about the handle member 31 while the two spacer elements 20 are positioned centrally on either side of the handle member 31. The tail end 13 is pulled through the locking head end 12 until the cordless tool holder adaptor 1 is securely fastened to the handle member 31 and cannot be rotated about the handle member. In step 3, the tail end 13 is guided through the central aperture 21 of one of the spacer elements 20 and the other spacer element is guided over the locking head end 12. In step 4, the combination assembly comprising the cordless tool and cordless tool holder adaptor is suspended from hook member 43 of tool belt clip 40.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. In combination with a tool, said tool comprising a handle member having a first side and a second opposite side, a tool holder adaptor, said tool holder adaptor comprising:

(1) a cable tie in the form of an elongated strap having a first surface provided with a plurality of teeth, a locking head end and a tail end, said locking head end being provided with a locking aperture disposed therein which is capable of receiving said tail end, said locking aperture having a locking mechanism for retaining said elongated strap within said locking head end; and (2) two spacer members, each spacer member being provided with a central aperture which is capable said receiving said tail end, wherein, when said tail end of said tool holder adaptor is introduced through said two spacer members and said locking aperture and pulled tightly about said handle member in such a manner that one of said two spacer members is situated on said first side of said handle member and the other of said two spacer members is situated on said second opposite side of said handle member, a combination assembly is created.

2. The tool holder adaptor in accordance with claim 1, wherein each of said two spacer members is the form of a ball.

3. The tool holder adaptor in accordance with claim 1, wherein said locking mechanism is capable of releasably retaining said cable tie within said locking head end.

4. The tool holder adaptor in accordance with claim 1, wherein said combination assembly is capable of being suspended from a hook member.

5. The tool holder adaptor in accordance with claim 4, wherein said hook member is swivelably secured to a belt clip.

6. The tool holder adaptor in accordance with claim 1, wherein said tool is a cordless tool.

7. The tool holder adaptor in accordance with claim 6, wherein said handle member of said cordless tool is configured with a flanged lower end.

8. The tool holder adaptor in accordance with claim 7, wherein said cordless tool is a cordless power drill.

9. The tool holder adaptor in accordance with claim 7, wherein said elongated strap is pulled tightly about said handle member above its flanged lower end in such a manner that each of said two spacer members contacts said handle member near its flanged lower end.

10. The tool holder adaptor in accordance with claim 1, in further combination with a belt clip comprising a hook member capable of freely swiveling at least about 180°.

11. The tool holder adaptor in accordance with claim 10, wherein said belt clip further comprises a swivel element joining said hook member to said belt clip.

12. In combination with a belt clip comprising a hook member capable of freely swiveling at least about 180°, a tool holder adaptor capable of being secured to a tool having a handle member, said tool holder adaptor comprising:

(1) a cable tie in the form of an elongated strap having a first surface provided with a plurality of teeth, a locking head end and a tail end, said locking head end being provided with a locking aperture disposed therein which is capable of receiving said tail end, said locking aperture having a locking mechanism for retaining said elongated strap within said locking head end; and (2) two spacer members, each spacer member being provided with a central aperture which is capable said receiving said tail end, wherein, when said tool holder adaptor is installed onto a tool in such a manner that one of said two spacer members is situated on a first side of the handle member and the other of said two spacer elements is situated on a second side opposite the first side of the handle member, and the cable tie is pulled tightly about the handle member, the tool can be suspended from said hook member.

13. The combination of claim 12, wherein said belt clip further comprises a swivel element joining said hook member to said belt clip.

14. The tool holder adaptor in accordance with claim 13, wherein each of said spacer members is in the form of a ball.

15. The tool holder adaptor in accordance with claim 12, wherein said locking mechanism is capable of releasably retaining said cable tie within said locking head end.

16. The tool holder adaptor in accordance with claim 12, wherein the tool is a cordless tool.

17. The tool holder adaptor in accordance with claim 16, wherein the handle member of the cordless tool is configured with a flanged lower end.

18. The tool holder adaptor in accordance with claim 17, wherein the cordless tool is a cordless power drill.

19. The tool holder adaptor in accordance with claim 17, wherein said elongated strap is pulled tightly about the handle member above its flanged lower end in such a manner that each of said two spacer members contacts said handle member near its flanged lower end.

* * * * *